US008800173B2

(12) United States Patent
Smith

(10) Patent No.: US 8,800,173 B2
(45) Date of Patent: Aug. 12, 2014

(54) SHOELACE PROTECTOR AND METHODS THEREOF

(76) Inventor: Nicholas Smith, El Segundo, CA (US)

( * ) Notice: Subject to any disclaimer, the term of this patent is extended or adjusted under 35 U.S.C. 154(b) by 183 days.

(21) Appl. No.: 13/215,417

(22) Filed: Aug. 23, 2011

(65) Prior Publication Data

US 2013/0047470 A1 Feb. 28, 2013

(51) Int. Cl.

| | |
|---|---|
| ***A43C 11/00*** | (2006.01) |
| ***A43B 11/00*** | (2006.01) |
| ***A43C 7/00*** | (2006.01) |
| ***A43C 5/00*** | (2006.01) |

(52) U.S. Cl.
USPC ..... 36/50.1; 36/52; 24/712.4; 24/713.6

(58) Field of Classification Search
USPC ..... 24/713.7, 713.6, 713.8, 714.6, 714.8; 36/52, 72 R, 50.1, 136, 56
See application file for complete search history.

(56) References Cited

U.S. PATENT DOCUMENTS

| | | | | |
|---|---|---|---|---|
| 1,039,030 | A | 9/1912 | Colt | |
| 1,043,888 | A | 11/1912 | Wilson | |
| 1,168,771 | A * | 1/1916 | Weatherley | 267/74 |
| 1,489,470 | A * | 4/1924 | Thomas | 24/713.7 |
| 2,143,087 | A * | 1/1939 | Rau | 24/713.7 |
| 4,633,548 | A * | 1/1987 | Siskind et al. | 24/715.1 |
| 4,958,459 | A * | 9/1990 | Davidson | 40/636 |
| 5,671,517 | A | 9/1997 | Gourley | |
| 6,240,657 | B1 | 6/2001 | Weber | |
| 6,260,246 | B1 * | 7/2001 | Lampkins | 24/712.1 |
| 6,622,357 | B2 * | 9/2003 | Jackson et al. | 24/712 |
| 7,334,353 | B2 * | 2/2008 | Lampkins | 36/50.1 |
| 2006/0075614 | A1 | 4/2006 | Chmelar | |
| 2010/0325922 | A1 | 12/2010 | Esposito | |

* cited by examiner

*Primary Examiner* — Khoa Huynh
*Assistant Examiner* — Katherine Gracz
(74) *Attorney, Agent, or Firm* — Weiss & Moy, P.C.; Jeffrey D. Moy

(57) ABSTRACT

A shoelace protector can include a fastening member, enclosure and upper section. The fastening member can be inserted into to an eyelet of a shoe to properly support the shoelace protector. The shoelace can be strung into the fastening member and through the enclosure. The enclosure can surround the shoe lace on an exterior portion of the shoe. The shoelace can then be placed through the upper section. The upper section can provide a narrow slit such that the shoelace can be fit therethrough. Two or more shoelace protectors can be fitted into the eyelets of the shoe. The protectors can be positioned on the lower eyelets such that the bend created by the eyelet on the shoelace can be protected during use.

4 Claims, 2 Drawing Sheets

SHOELACE PROTECTOR AND METHODS THEREOF

TECHNICAL FIELD

This disclosure generally relates to shoes, and more particularly, to a guard that prevents a shoelace from being frayed or damaged.

BACKGROUND

At the 2011 X Games in Los Angeles, Calif., Shaun White earned his second gold medal in vertical skateboarding. During the competition, he was able to perform tricks to top his competitors. His skills as well as his equipment provided success. Not only was the type of board he used vital, but his footwear was important as well. Skate shoes designed and manufactured especially for his use made his achievements possible. The design of his skate shoe included many features for use in skateboarding.

Skate shoe companies have integrated a number of special features into their shoes. These innovations have a number of functions including preventing heel bruises and increasing a "skateboard feel" through increased flexibility and enhancing grip. Many features of a skate shoe are designed to increase their durability. Skate shoes are subjected to the abrasiveness of a skateboard's grip tape on a regular basis when worn by skaters. Super suede, action leather, and plastic underlying the toe cap can help increase the durability of a skate shoe. Other common features include triple stitching with thicker treads to prevent ripping, more width so that there is more contact with the board with thicker tongues and sides to compensate and deep sole patterns for grip.

In addition, lace loops and protectors are designed to prevent laces from shredding by shielding the most common areas that contact with grip tape. Nevertheless, current guards are either too expensive or do not provide the durability within today's competitions. Furthermore, these devices do not address where the shoelace is most likely to break, that is, where the shoelace bends after coming out of an eyelet. A need therefore exists for a shoelace protector that overcomes these, as well as other related, challenges.

SUMMARY

This summary is provided to introduce a selection of concepts in a simplified form that are further described below in the DESCRIPTION OF THE DISCLOSURE. This summary is not intended to identify key features of the claimed subject matter, nor is it intended to be used as an aid in determining the scope of the claimed subject matter.

In accordance with one aspect of the present disclosure, a device for protecting a shoelace on a shoe is provided. The device can include a fastening member inserted to an eyelet of the shoe receiving the shoelace. In addition, the device can include an enclosure coupled to the fastening member surrounding the shoelace on an exterior of the shoe. The device can also include an upper section coupled to the enclosure securing the shoelace.

In accordance with another aspect of the present disclosure, a shoe is provided. The shoe can include a sole and an upper connected to the sole, the upper including a first vamp section and a second vamp section and a plurality of eyelets in the vamp sections. In addition, the shoe can include a lace-binding system for drawing the vamp sections together having a plurality of eyelets. The shoe can also include at least one lace guard positioned within the plurality of eyelets. Each guard can include a semicircular section receiving a lace. In addition, the lace guard can include a curved portion coupled to the semicircular section providing protection to the lace where the lace bends. The lace guard can also include a bracket coupled to the curved portion guiding the lace.

In accordance with yet another aspect of the present disclosure, a method of protecting a lace is provided. The method can include providing a lace guard having a fastening member, enclosure and upper section and securing the lace guard by placing the fastening member into an eyelet. In addition, the method can include placing the lace through the eyelet and fastening member and placing the lace through the enclosure where the lace bends. The method can also include pulling the lace through the upper section.

BRIEF DESCRIPTION OF DRAWINGS

The novel features believed to be characteristic of the disclosure are set forth in the appended claims. In the descriptions that follow, like-parts are marked throughout the specification and drawings with the same numerals, respectively. The drawing figures are not necessarily drawn to scale and certain figures can be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein:

DESCRIPTION OF THE DISCLOSURE

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

Generally described, the present disclosure relates to footwear. More specifically, this disclosure relates to a shoelace protector and methods thereof. In one illustrative embodiment, the shoelace protector can include a fastening member, enclosure and upper section. The fastening member can be inserted into to an eyelet of a shoe to properly support the shoelace protector. The shoelace can be strung into the fastening member and through the enclosure. The enclosure can surround the shoe lace on an exterior portion of the shoe. The shoelace can then be placed through the upper section. The upper section can provide a narrow slit such that the shoelace can be fit therethrough. One or more shoelace protectors can be fitted into eyelets of the shoe. The protectors can be positioned on the lower eyelets such that the bend created by the eyelet on the shoelace can be protected during use.

A number of advantages can be offered by the illustrative embodiment described above. The shoelace protector provides a guard at the most critical portion of the shoelace, that is, where the shoelace bends at the eyelets. The protector allows for durability expected among top skaters for performing tricks or other maneuvers. Instead of covering the entire shoelace, a small portion of the shoelace is covered. The protector allows the shoelace to be mostly exposed. In addition, the shoelace protector can be easy to install without re-lacing the shoe. Many additional advantages of the present disclosure will become apparent to those skilled in the relevant art as provided for in the following description.

Figure 2:
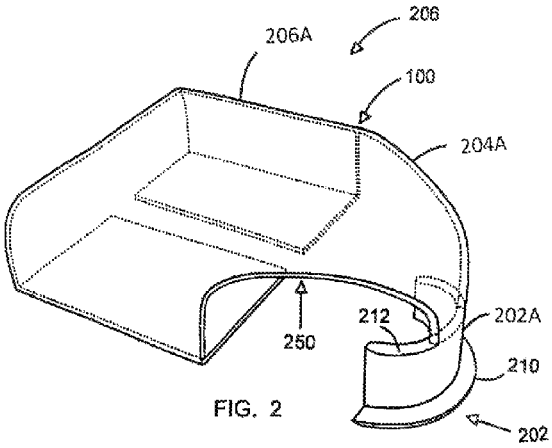
FIG. 2 is a closer top perspective see-through view of the exemplary shoelace protector of FIG. 1.
Figure 3:
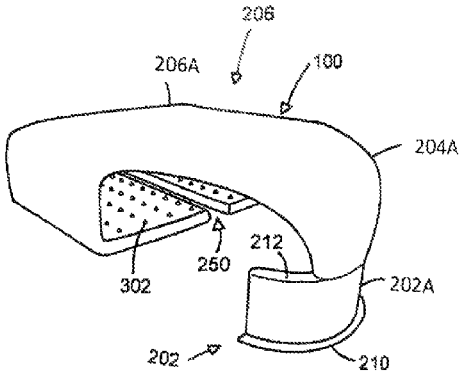
FIG. 3 is a closer side angled view of the exemplary shoelace protector of FIG. 1.
Figure 4:
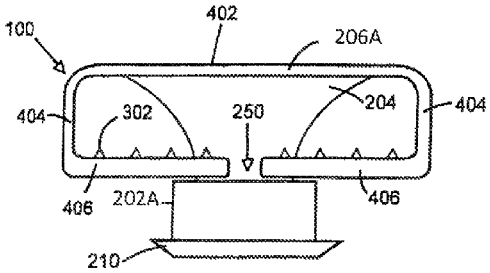
FIG. 4 is a side view of the exemplary shoelace protector opposite the eyelet side of FIG. 1.
Figure 1:
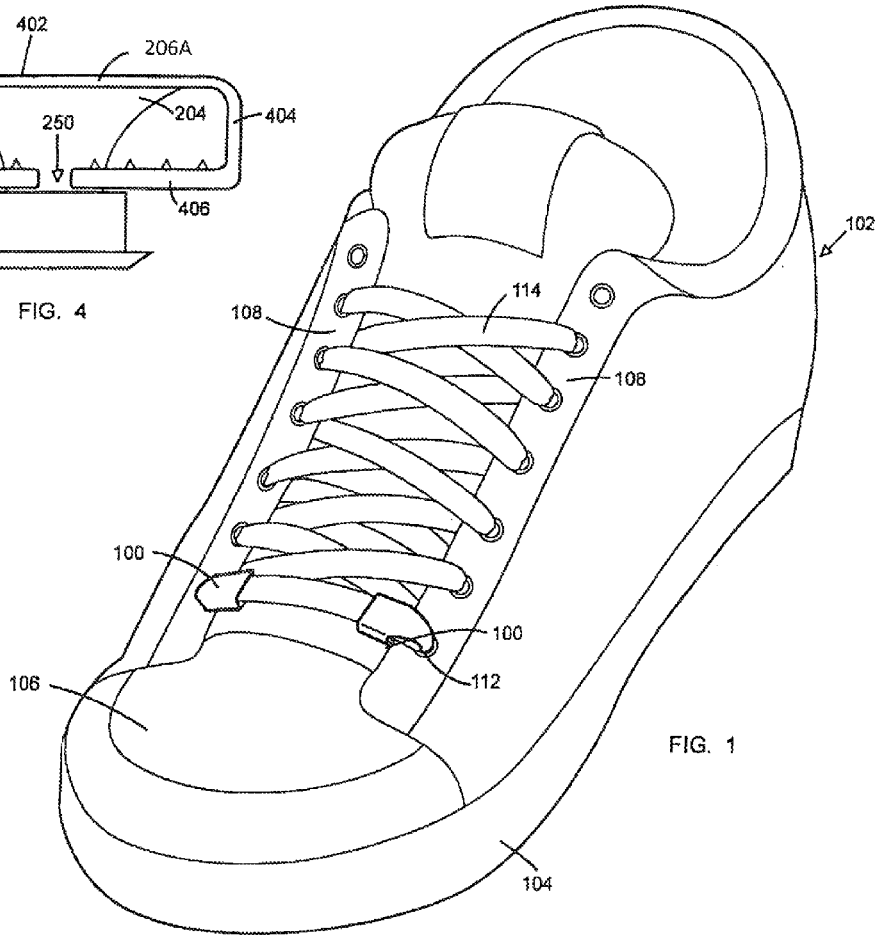
FIG. 1 is a top perspective view of an exemplary shoelace protector in accordance with one or more aspects of the present disclosure.

An environment in which the shoelace protector can be used will be shown in FIG. 1. FIGS. 2 through 4 then provide different views of the shoelace protector. Thereafter, a method for inserting the shoelace protector will be described in FIGS. 5 through 8. For purposes of the present disclosure, the term shoelace protector can also be referred to as a guard or protector and can be interchanged throughout. Shoelace can be referred to as a string or rope and can be interchangeable within the present disclosure. While primarily described in skateboarding applications, i.e. shoes, the protector can be used in other areas, for example, clothes. The clothes can have eyelets and laces to tie ends of an article. Other larger applications can use features of the protector described herein. For example, any application where a string, rope or chain can be used and bends.

Turning to FIG. 1, a top perspective view of an exemplary shoelace protector 100 in accordance with one or more aspects of the present disclosure is provided. The protector 100 can be placed within a shoe 102 or other item where a lace 114 can be used. The shoe 102 can include a sole 104, an upper 106 connected to the sole 104, vamp sections 108 connected to the upper 106 and a plurality of eyelets 112 in the vamp sections 108. Typically, the eyelets 112 are used to prevent tearing of a hole through the vamp sections 108 thereby providing structural integrity. The eyelets 112 can be circular or be made in another shape. Typically, the eyelet 112 punctures through the cloth or leather of the shoe 102. In one embodiment, the eyelets 112 can be made of metal, plastic, rubber or the like. Alternatively, not all shoes have eyelets 112 made out of these materials. Instead, the eyelets 112 can be merely punctures within the vamp sections 108.

A lace-binding system can be incorporated into the shoe 102. The system can be used for drawing the vamp sections 108 together through the use of the eyelets 112 and the shoelace 114. The shoelace 114 can be made of leather, cotton, jute or other materials used in the manufacture of rope. The lace-binding system can secure the user's foot to the shoe 102 through a process known as lacing. Numerous types of lacing are known to those skilled in the relevant art. These processes can include criss-cross lacing, double-helix lacing, and check-board lacing. Each shoelace 114 typically passes through a series of eyelets 112, as described above, on either side of the shoe 102. Loosening the shoelaces 114 allows the shoe 102 to open wide enough for the foot to be inserted or removed. Tightening the shoelaces 114 and tying off the ends secures the foot within the shoe 102.

As shown by the lacing, the shoelace 114 bends at the eyelets 112. Typically, these bends are the first areas where the shoelace 114 can become frayed or damaged. While using a skateboard, the fray or damage in the shoelace 114 can become more apparent at the lower eyelets 112. To prevent this, as shown in FIG. 1, the bottom two eyelets 112 have shoelace protectors 100. This is generally not intended to protect the entire shoelace 114. Instead, the shoelace protector 100 can be designed to protect a skateboarder's laces 114 where the skateboard makes contact with the shoe 102, and in particular, the grip tape found on skateboards. In other embodiments, each of the eyelets 112 can have a shoelace protector 100. Alternatively, a different combination of placing the shoelace protectors 100 can be provided. While only one shoe 102 is shown, those skilled in the relevant art will appreciate that the shoelace protectors 100 can be placed on another shoe 102 with similar features.

FIG. 2 is a closer top perspective see-through view of the exemplary shoelace protector 100 of FIG. 1. The shoelace protector 100 is intended to be fit into individual eyelets 112. When measuring the protector 100, it can vary in size, but is generally only millimeters in length and width. The protector 100 can include a fastening member 202, enclosure 204 and upper section 206. Each of these sections can be made of plastic. Alternatively, these sections can be made of a variety of other materials that provide durability, for example, rubber, metal, etc. While described below as separate pieces, the shoelace protector 100 can be thought of as a single piece.

The fastening member 202 can be the portion of the shoelace protector 100 that couples it to the shoe 102. The member 202 can take on the form of an elongated semicircular section as shown in FIG. 2. The semicircular section 202 can have a height such that it extends above and below the vamp sections 108 through the eyelets 112. Alternatively, the fastening member 202 can be positioned below the vamp sections 108 and under the eyelets 112 altogether. The fastening member 202, in one embodiment, can include a full circular portion. It is intended, however, that the protector 100 can be easily inserted and removed hence, the semicircular shape. In one embodiment, the fastening member 202 can be provided in a number of determined shapes and sizes, for example, the member 202 can be formed as a half square such that it can be placed through a square eyelet 112.

The bottom of the fastening member 202 can be coupled to a flare or collar 210. The collar 210 can extend upwards as shown in FIG. 4, which provides for a side view of the exemplary shoelace protector 100 opposite the eyelet side 112 of FIG. 1. The collar 210 can prevent the shoelace protector 100 from slipping out. The collar 210 can have a relatively flat bottom to provide comfort to the user. There can be a number of different types of mechanisms that can hold the protector 100 into place through the eyelet 112. The fastening member 202 can also have a top edge 212 as shown in FIG. 2. The edge 212 can be further used to prevent the member 202 from slipping out of the eyelet 112. While several embodiments of the fastening member 202 have been provided, numerous implementations can be realized and are within the scope of the present disclosure.

The enclosure 204 of the shoelace protector 100 will now be disclosed. The enclosure 204, in one embodiment, can have an extending curved portion. This curved portion 204 can extend perpendicularly or normal from the fastening member 202. When placed within the eyelet 112 the enclosure 204 can point or be directed towards a centerline of the shoe or lacing. In one embodiment, the enclosure 204 can form an arch as more clearly shown in FIGS. 2 and 3. When the shoelace 114 is bent at the eyelet 112, the arch or enclosure 204 can protect the shoelace 114 from becoming damaged. The shoelace 114, at the bend, is most likely to come in contact with the skateboard as described earlier. Pressure and friction applied to the angle formed by the shoelace 114 is thereby removed through the use of the enclosure 204.

While the enclosure 204 is generally not in contact with the shoelace 114, it can provide a barrier to which a buffer is created from the contact. The tension on the shoelace 114 tends to make the shoelace 114 bend on the eyelet 112 without making contact with the shoelace protector 100. The enclosure 204 surrounds the shoelace 114 from the exterior of the shoe 102. The enclosure 204, as shown in the FIGURES, does not entirely surround the shoelace 114. Instead, the enclosure 204 protects only one side whereby the shoelace 114 is allowed to operate normally and rub against the eyelet 112 and the vamp section 108. By providing this type of enclosure 204, the shoelace protector 100 can be easily inserted onto the eyelet 112 and the shoelace 114. The enclosure 204 protects the shoelace 114 from exterior forces at the bend at the eyelet 112 on a top portion of the shoelace 114. The enclosure 204, as such, can provide an underneath portion whereby the shoelace 114 can be seen stretched around the eyelet 112. Generally, the enclosure 204 tapers in and follows the shoelace 114 into the eyelet 112.

An upper section 206 of the shoelace protector 100 can be coupled to the enclosure 204 shown in FIGS. 2 through 4. The shoelace 114 can be received from the enclosure 204 and then fit through the upper section 206. The upper section 206 can take the form of a bracket 206A. In one embodiment, the bracket 206A can have a rectangular shape. The bracket 206A can include an insertion slit 250 that extends the length of the bracket 206A. Referring to FIG. 3, a closer side angled view of the exemplary shoelace protector 100 of FIG. 1 is provided. Through this slit 250, the shoelace 114 can be inserted therethrough without ever having to re-lace the shoe 102. This can provide for easy replacement of the shoelace protector 100.

On the interior of the upper section 206, the bracket 206A can have a top 402, side sections 404 and bottom sections 406 as shown in FIG. 4. The bottom sections 406, in one embodiment, do not connect with one another. These disconnected bottom sections 406 can form the slit 250 for inserting the shoelace 114. The width and length of the bracket 206A can vary depending on the shoe 102 and the shoelace 114. Generally, the length of the bracket 206A covers the area of the shoelace 114 that comes into contact with the skateboard.

In one embodiment, the bracket 206A can include tacks or fastening mechanisms 302. The tacks 302 can be secured to the bottom sections 406 of the bracket 206A. Alternatively, the tacks 302 can be placed on any of the sections on the interior of the bracket 206A. When the shoelace 114 is inserted, the tacks 302 can prevent the shoelace 114 from shifting or moving. In one embodiment, no tacks 302 are used.

Figure 5:
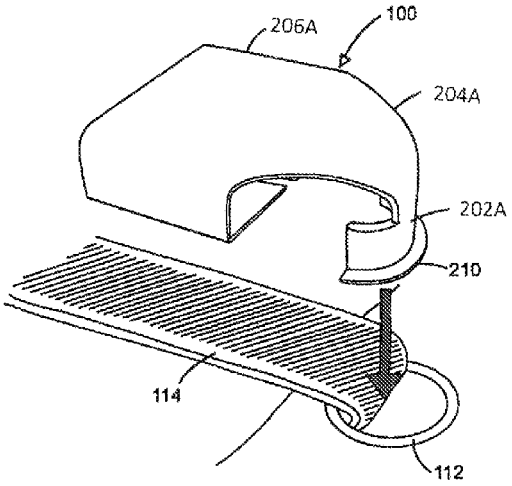
FIG. 5 is a top perspective view of the exemplary shoelace protector of FIG. 1 being inserted into an eyelet of an illustrative shoe.
Figure 6:
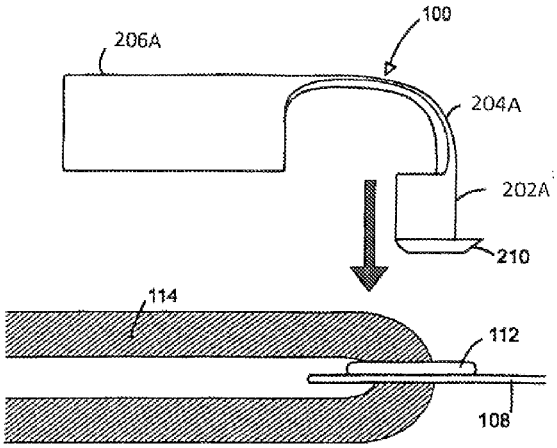
FIG. 6 is a side view of the exemplary shoelace protector of FIG. 1 being inserted into the eyelet of the illustrative shoe.

Turning now to FIG. 5, a top perspective view of the exemplary shoelace protector 100 of FIG. 1 being inserted into an eyelet 112 of an illustrative shoe 102 is provided. As shown, the shoelace 114 bends at the eyelet 112. To protect this portion of the shoelace 114, the shoelace protector 100 can be inserted therethrough. The collar 210 can be inserted into the eyelet 112 by pushing the shoelace protector 100 through, as indicated by the arrow. A portion of the fastening member 202 can extend above and below the eyelet 112. In one embodiment, the member 202 can be positioned wholly below the eyelet 112 or the vamp section 108. FIG. 6 is a side view of the exemplary shoelace protector 100 of FIG. 1 being inserted into the eyelet 112 of the illustrative shoe 102.

Figure 7:
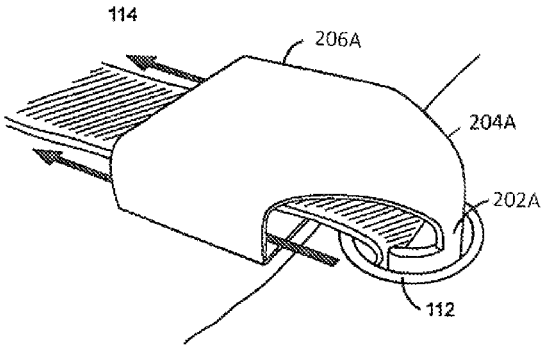
FIG. 7 is a top perspective view of the exemplary shoelace protector of FIG. 1 inserted into the eyelet of the illustrative shoe.

FIG. 7 is a top perspective view of the exemplary shoelace protector 100 of FIG. 1 inserted into the eyelet 112 of the illustrative shoe 102. As shown, the fastening member 202 has been coupled to the shoe 102 through the eyelet 112. The shoelace 114 can be pulled through the eyelet 112 and past the fastening member 202. The shoelace 114 can then be placed under the enclosure 204. Generally, the enclosure 204 does not touch the shoelace 114 as it bends across the eyelet 112 and goes through the upper section 206. The shoelace 114 can be protected by the enclosure 114 on the side that is normally exposed, that is, where it would contact the skateboard. When contact is made on the outer side of the enclosure 204, the pressure can be absorbed by the enclosure 204 and not at the shoelace 114 bend. The shoelace 114 can be then strung into the upper section 206 through the slit 250.

Figure 8:
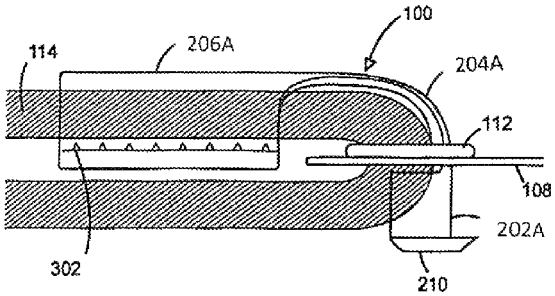
FIG. 8 is a cross sectional view of the exemplary shoelace protector of FIG. 1 inserted into the eyelet of the illustrative shoe.

FIG. 8 is a cross sectional view of the exemplary shoelace protector 100 of FIG. 1 inserted into the eyelet 112 of the illustrative shoe 102. In this embodiment, the fastening member 202 can be inserted below the eyelet 112 and vamp 108. The member 202 can come in a variety of configurations and be placed below or above the eyelet 112 and vamp 108, as shown in the previous description. A number of tacks 302 can be supported on the upper section 206 to prevent the shoelace 114 from moving. The tacks 302 can be placed in the interior of the upper section 206. The tacks 302 can be placed at other locations on the upper section 206 such as on an outer portion. While embodiments have been shown for inserting or applying the protector 100 to the shoelace 114, those skilled in the relevant art will appreciate that other methods exist. For example, the shoelace 114 can be re-laced while inserting the protectors 100 thereon. Nevertheless, it is intended that the protector 100 be easily inserted to provide protection to the shoelace 114 without re-lacing.

As shown in the previous FIGURES, a number of embodiments of the present disclosure exist. In accordance with one aspect of the present disclosure, a shoelace protector 100 for protecting a shoelace 114 on a shoe 102 can be provided. The shoelace protector 100 can include a fastening member 202 inserted to an eyelet 112 of the shoe 102 receiving the shoelace 114. In addition, the shoelace protector 100 can include an enclosure 204 coupled to the fastening member 202 surrounding the shoelace 114 on an exterior of the shoe 102. The device 100 can also include an upper section 206 coupled to the enclosure 204 securing the shoelace 114.

In one embodiment, the fastening member 202 can include a semicircular elongated section 202A, wherein the semicircular elongated section 202A can be placed within the eyelet 112 of the shoe 102. In one embodiment, the semicircular elongated section 202A can include a flared or collared side 210 placed within the eyelet 112 of the shoe 102 for securing the shoelace protector 100 to the shoe 102. In one embodiment, the semicircular elongated section 202A can secure the shoelace 114 on an interior side. In one embodiment, the semicircular elongated section 202A can be positioned below the eyelet 112 and rise above the eyelet 112.

In one embodiment, the enclosure 204 can include an extending curved portion 204A whereby the extending curved portion 204A can be coupled to the fastening member 202 perpendicularly and extend towards a centerline of the shoe 102. In one embodiment, the extending curved portion 204A can be positioned above the shoelace 114 wherein the shoelace 114 bends out of the eyelet 112.

In one embodiment, the upper section 206 can include a bracket having a narrow slit 250 formed along a length of the bracket 206A. In one embodiment, the bracket 206A can include at least one tack 302 on an interior portion securing the shoelace 114. In one embodiment, the at least one tack 302 can be positioned at a bottom 406 of the interior portion.

In accordance with another aspect of the present disclosure, a shoe 102 is provided. The shoe 102 can include a sole 104 and an upper 106 connected to the sole 104, the upper 106 can include a first vamp section 108 and a second vamp section 108 and a plurality of eyelets 112 in the vamp sections 108. In addition, the shoe 102 can include a lace-binding system for drawing the vamp sections 108 together having a plurality of eyelets 112. The shoe 102 can also include at least two shoelace protectors 100 positioned within the plurality of eyelets 112. Each of the shoelace protectors 100 can include a semicircular section 202 receiving a lace 114. In addition, the shoelace protectors 100 can include a curved portion 204A coupled to the semicircular section 202A providing protection to the lace 114 where the lace 114 bends. The shoelace protectors 100 can also include a bracket 206A coupled to the curved portion 204A guiding the lace 114.

In one embodiment, the at least two shoelace protectors 100 can be positioned at eyelets 112 lowest on the shoe 102. In one embodiment, the semicircular section 202A can include a flare or collared bottom portion 210. In one embodiment, the semicircular section 202A can be placed within an eyelet 112 of the shoe 102. In one embodiment, the semicircular section 202A can be positioned below a vamp section 108 and can extend to a position above. In one embodiment, the bracket 206A can include at least one tack 302 on an interior portion securing the lace 114. In one embodiment, the shoelace protector 100 can be made of at least one of a metal, plastic and rubber.

In accordance with yet another aspect of the present disclosure, a method of protecting a lace 114 is provided. The method can include providing a shoelace protector 100 having a fastening member 202, enclosure 204 and upper section 206 and securing the shoelace protector 100 by placing the fastening member 202 into an eyelet 112. In addition, the method can include placing the lace 114 through the eyelet 112 and fastening member 202 and placing the lace 114 through the enclosure 204 where the lace 114 bends. The method can also include pulling the lace 114 through the upper section 206.

In one embodiment, wherein placing the lace 114 through the enclosure 204 where the lace 114 bends can include positioning the lace 114 under the enclosure 204. In one embodiment, the method can include securing the lace 114 within the upper section 206 by providing tacks 302 within an interior portion of the upper section. In one embodiment, the method can include securing a second shoelace protector 100 on a second eyelet 112 opposite to the shoelace protector 100.

The foregoing description is provided to enable any person skilled in the relevant art to practice the various embodiments described herein. Various modifications to these embodiments will be readily apparent to those skilled in the relevant art, and generic principles defined herein can be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

What is claimed is:

1. A device for protecting a shoelace on a shoe comprising:

an elongated fastening member configured to receive said shoelace, wherein said elongated fastening member is entirely semicircular and has a top edge and has a collar coupled to a bottom of the elongated fastening member, and wherein said elongated fastening member is adapted to be inserted within a shoe eyelet;

an enclosure coupled to said elongated fastening member, wherein said enclosure is adapted to surround only a top portion of said shoelace and comprises a curved portion that engages the top edge of said elongated fastening member perpendicularly and designed to extend towards a centerline of said shoe, wherein said curved portion is adapted to cover said top portion of said shoelace; and an upper section coupled to said enclosure, wherein said upper section is adapted to secure said shoelace within said upper section, wherein said upper section comprises:

a top section;

side sections extending down from said top section;

bottom sections extending from said side sections; and a slit formed between said bottom sections.

2. The device of claim 1, wherein said collar is adapted to be positioned below said shoe eyelet and said top edge is adapted to rise above said shoe eyelet.

3. The device of claim 1 further comprising a plurality of tacks formed on the bottom sections of said upper section to prevent movement of said shoelace.

4. The device of claim 1, wherein said curved portion is designed to be extended and positioned above said shoelace where said shoelace is adapted to bend out of said eyelet.

* * * * *